United States Patent [19]

Nava

[11] Patent Number: 4,925,244

[45] Date of Patent: May 15, 1990

[54] CHAIR ELEMENT WHICH CAN BE PERSONALIZED

[75] Inventor: Paolo Nava, Lissone, Italy

[73] Assignee: SpA Tonon & C., Manzano, Italy

[21] Appl. No.: 291,651

[22] Filed: Dec. 29, 1988

[30] Foreign Application Priority Data

Apr. 29, 1988 [IT] Italy ..... 60352/88[U]

[51] Int. Cl.[5] ..... A47C 7/00

[52] U.S. Cl. ..... 297/440; 297/443; 248/188.8

[58] Field of Search ..... 297/445, 446, 444, 450, 297/454, 457, 440; 248/188.8

[56] References Cited

U.S. PATENT DOCUMENTS

| | | | |
|---|---|---|---|
| 558,830 | 4/1896 | McCure | 297/444 |
| 660,146 | 10/1900 | Charbonneau | 297/443 X |
| 2,620,024 | 12/1952 | Rietman | 297/440 |
| 2,642,118 | 6/1953 | Lamb | 297/457 X |
| 2,965,161 | 12/1960 | Knoll | 297/440 |
| 3,087,758 | 4/1963 | Deaton | 297/440 |
| 3,301,597 | 1/1967 | Bereday | 297/450 |
| 3,318,635 | 5/1967 | Barecki et al. | 297/446 |
| 3,510,159 | 5/1970 | Waag et al. | 248/188.8 |
| 3,547,491 | 12/1976 | Bovasso | 297/440 |
| 4,302,048 | 11/1981 | Yount | 297/440 |

*Primary Examiner*—Francis K. Zugel

*Attorney, Agent, or Firm*—Wegner & Bretschneider

[57] ABSTRACT

Chair element which can be personalized and to which can be fitted various types of seatbacks (20) or seat surface (21) which are and can be differentiated as regards their shape, the element comprising a bearing structure (10) with rear legs (12) that include a short extension (16) above a support surface (17) of the seat surface (21), the bearing structure (10) cooperating with a self-supporting seatbeak (20).

3 Claims, 2 Drawing Sheets

CHAIR ELEMENT WHICH CAN BE PERSONALIZED

This invention concerns a chair element which can be personalized. To be more exact, the invention concerns a chair element structure to which can be fitted various personalizing elements either as seatbacks or as seat surfaces.

Various attempts to produce chair elements that can be variously personalized are known, in general these attempts start with frames having front and rear legs to which are fitted seatbacks and seat surfaces, but the conformation of the shape always remains constant even though upholstered elements or flat elements or elements covered with straw or with woven straw are included.

The present applicant has set himself the problem of embodying a chair element structure and a resulting chair which, starting with a standardized structure, enable a very wide range of shapes and technical and physiological requirements to be met.

The chair element which can be personalized according to the invention and can meet such requirements and overcome the limitations of the state of the art is set forth in the main claim, while the dependent claims describe variants of the idea of the embodiment.

According to the invention a structure is provied which comprises rear legs that extend slightly above the seat surface.

Cooperation between the rear legs, lateral members and the rear cross member creates a lodgement for the seatback, which is self-supporting.

The seatbacks of the seat surfaces can be smooth, lacquered, painted, upholstered, covered with straw, etc.

The seatbacks may also be low, high, broad or narrow and may also include arms.

The seat surfaces may have any shape.

The seatbacks will include a lower protrusion, the length of which will concur with the resulting shape, which in turn will concur with the anchorage of the seatback to the bearing structure.

Figure 2:
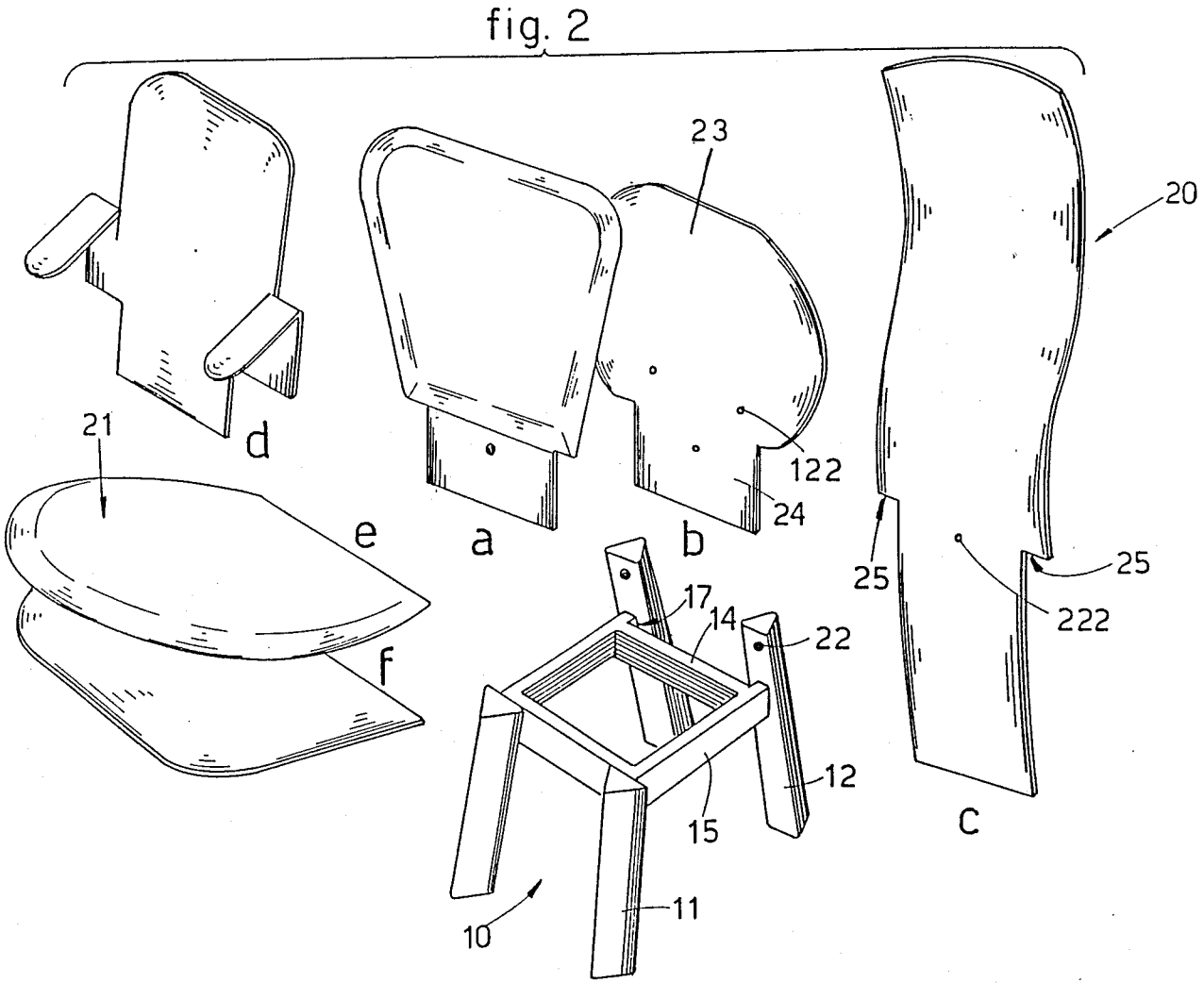

The attached figures, which are given as a non-restrictive example, show the following:

FIGS. 1 give various views of a bearing structure according to the invention;

FIGS. 2 show the ability to change the elements (seatback and seat surface) so as to embody the required personalization.

FIGS. 1 show a bearing structure 10 with front legs 11, rear legs 12, front cross member 13, rear cross member 14 and lateral members 15.

Other members too may be provided and the legs 11–12 may have any desired section. The section of the legs will preferably be substantially triangular, but this section is not binding.

The cross and lateral members 13–14–15 may also include holes to make them lighter.

The rear cross member 14 is secured to the lateral members 15 at a position slightly distanced from the rear legs 12 so as to create lateral gaps 17.

The rear legs 12 include an extension 16 above the support surface 19 of the seat surface 21, this extension being of a small value and comprising advantageously a surface platfom 18 for the seatbacks 20.

Figure 1C:
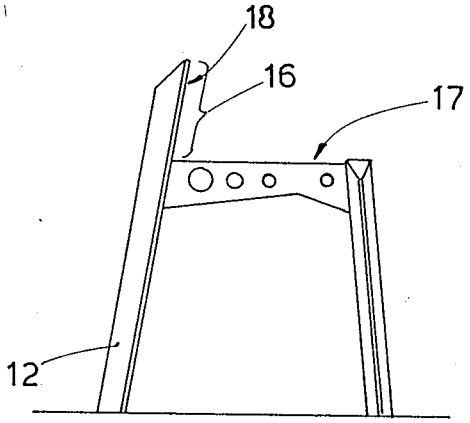
Figure 1D:
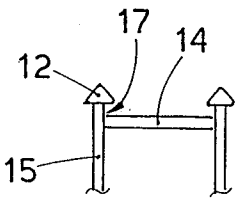

As shown in FIG. 1*c*, the rear legs 12 are advantageously sloped backwards in the downward direction by an angle between six and fifteen degrees.

Figure 1A:
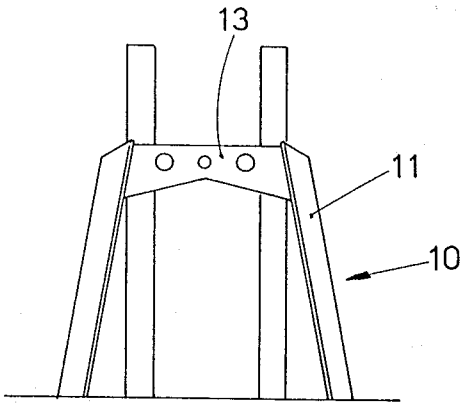
Figure 1B:
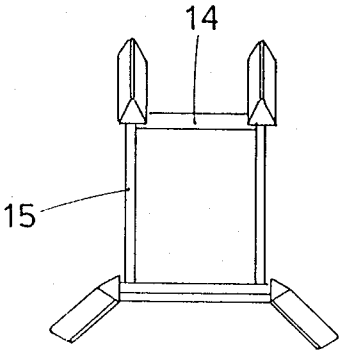

As shown in FIGS. 1*a* and 1*b*, the front legs 11 advantageously diverge outwards and are advantageously sloped slightly forwards in the downward direction.

Seats 21, which are shown as an example in FIGS. 2*e* and 2*f* alone, may have any shape or size and may be lacquered, painted, upholstered, covered with straw or woven straw, etc. They are secured with two or more screws applied from below.

The seatbacks 20 are self-supporting and thus do not require rear stiffening legs.

The seatbacks 20 comprise a first zone 23 that acts as a real seatback and a second zone 24 that serves to secure the seatback 20 to the bearing structure 10.

The length of the second zone 24 concurs with the shape of the chair.

The first zone 23 may be upholstered (a), smooth (b), curved (c) and have arms (d) or may be covered with straw or woven straw.

The first zone 23 may have any configuration.

When the second zone 24 is fitted into the gaps 17, lateral projections 25 are supported on the lateral members 15.

Anchorage of the seatback 20 to the bearing structure 10 may be obtained with screws connecting appropriate holes 22 and 122 or with screws connecting holes 222 to holes in the rear cross member 14.

I claim:

1. Chair element which can be personalized, comprising:

a bearing structure;

a self-supporting seatback removably attached to said bearing structure, wherein said self-supporting seatback is provided with a lower zone, a first lateral projection and a second lateral projection; and a seat surface removably attached to said bearing structure;

wherein said bearing structure comprises:

a support surface comprising a front cross-member, a rear cross-member, a first lateral member, and a second lateral member, a pair of rear legs extending a short distance above said support surface and fixedly attached thereto, and a pair of front legs fixedly attached to said support surface, wherein said pair of front legs slope away from said pair of rear legs and diverge in a downward direction, wherein said rear legs slope away from said pair of front legs in a downward direction, and wherein said bearing structure has a gap between said rear cross-member and said pair of rear legs; and wherein said seat surface is supported by said support surface, wherein said lower zone of said self-supporting seatback is inserted in said gap between said rear cross member and said pair of rear legs, and wherein said first lateral projection communicates with said first lateral member, and said second lateral projection communicates with said second lateral member.

2. Chair element as claimed in claim 1, wherein said self-supporting seatback is provided with at least one arm.

3. Chair element as claimed in claim 1, wherein said pair of rear legs and said pair of front legs have a substantially triangular cross-section.

* * * * *